US005657638A

United States Patent [19]

Erdman et al.

[11] Patent Number: 5,657,638

[45] Date of Patent: Aug. 19, 1997

[54] TWO SPEED CONTROL CIRCUIT FOR A REFRIGERATOR FAN

[75] Inventors: David M. Erdman, Fort Wayne, Ind.; Warren F. Bessler, Schenectady, N.Y.

[73] Assignee: General Electric Company, Fort Wayne, Ind.

[21] Appl. No.: 538,115

[22] Filed: Oct. 2, 1995

[51] Int. Cl.[6] ..... F25D 17/06

[52] U.S. Cl. ..... 62/182; 62/186; 62/158

[58] Field of Search ..... 62/186, 180, 181, 62/182, 183, 158, 184, 157, 231, 229

[56] References Cited

U.S. PATENT DOCUMENTS

| | | | |
|---|---|---|---|
| 2,492,970 | 1/1950 | Curry | 62/182 X |
| 3,108,450 | 10/1963 | Crotser | 62/182 X |
| 3,739,596 | 6/1973 | Ballard | 62/158 |
| 3,998,068 | 12/1976 | Chirnside | 62/186 |
| 4,005,347 | 1/1977 | Erdman | 318/254 |
| 4,015,182 | 3/1977 | Erdman | 318/334 |
| 4,169,990 | 10/1979 | Lerdman | 318/138 |
| 4,297,851 | 11/1981 | Paddock et al. | 62/229 X |
| 4,449,079 | 5/1984 | Erdman | 318/138 |
| 4,459,519 | 7/1984 | Erdman | 318/254 |
| 4,860,552 | 8/1989 | Beckey | 62/180 X |
| 5,255,529 | 10/1993 | Powell et al. | 62/180 |
| 5,255,530 | 10/1993 | Janke | 62/180 |

OTHER PUBLICATIONS

Buxton, "Solid State Circuits Simplify Temperature Sensing and Control," pp. S5–S8.

*Primary Examiner*—Harry B. Tanner
*Attorney, Agent, or Firm*—Ralph E. Krisher, Jr.

[57] ABSTRACT

An apparatus for driving a fan as part of a refrigerator is disclosed. The refrigerator has a compartment, a compressor, an evaporator and a condenser. A temperature sensor is positioned in association with the compartment and outputs a sensed temperature signal as a function of the temperature in the compartment. The apparatus includes a reference circuit which provides a desired temperature signal representative of a desired temperature. A comparator compares the desired temperature signal and the sensed temperature signal and generates a cool signal when the compartment temperature is above the desired temperature. A timer times out an elapsed period of time commencing when the cool signal is generated. A motor includes a rotatable assembly in driving relation to the fan. A control circuit controls operation of the motor as a function of the sensed temperature signal and the elapsed period. Related apparatus and methods are also disclosed.

23 Claims, 1 Drawing Sheet

TWO SPEED CONTROL CIRCUIT FOR A REFRIGERATOR FAN

BACKGROUND OF THE INVENTION

The invention generally relates to motor controls and, in particular, to delaying or timing motor operation in refrigerators.

Evaporator and condenser fan speeds in production refrigerators must be set high enough to satisfy maximum load requirements. This causes fan noise and power levels which could be lowered during light load conditions by reducing fan speeds. Production refrigerators also generate undesirable temperature excursions after a defrost cycle when warm air is circulated by the evaporator fan. Internal cabinet condensation in the fresh food compartment may result from inadequate evaporator dehumidification, particularly in tropical climates.

SUMMARY OF THE INVENTION

Among the objects of the present invention are to provide an improved refrigerator fan control circuit having two speed operation and containing internal speed selection logic on its control broad; to provide an improved refrigerator fan control circuit which operates a fan at different speeds and with reduced noise; to provide an improved refrigerator fan control circuit which increases moisture removal and reduces temperature fluctuations; to provide an improved refrigerator fan control circuit which delays the evaporator and/or condenser fan operation following a compressor start up; to provide an improved refrigerator fan control circuit which saves energy by operating the condenser and evaporator fans at low speed whenever practical; to provide an improved refrigerator fan control circuit which does not require modification of the standard refrigerator wiring harness; to provide an improved refrigerator fan control circuit which is reliable in operation and inexpensive to manufacture.

Generally, in one form the invention provides an apparatus which drives an air moving assembly in a refrigerator. The refrigerator has a compartment, a compressor, an evaporator and a condenser. The refrigerator also has a temperature sensor positioned in association with the compartment which outputs a sensed temperature signal as a function of the temperature in the compartment. The apparatus includes a reference circuit which provides a desired temperature signal representative of a desired temperature and a comparator which compares the desired temperature signal and the sensed temperature signal and generates a cool signal when the compartment temperature is above the desired temperature. A timer times out an elapsed period of time in response to the cool signal is generated. A motor has a rotatable assembly in driving relation to the air moving assembly. The apparatus also includes a control circuit which controls operation of the motor as a function of the elapsed period.

Another form of the invention is an apparatus for a refrigerator. The refrigerator has a compartment, a compressor, an evaporator and a condenser. The refrigerator also has a temperature sensor positioned in association with the compartment which outputs a sensed temperature signal as a function of the temperature in the compartment. The apparatus includes a reference circuit which provides a desired temperature signal representative of a desired temperature and a comparator which compares the desired temperature signal and the sensed temperature signal and generates a cool signal when the compartment temperature is above the desired temperature. A timer times out an elapsed period of time in response to the cool signal is generated. The apparatus also includes an air moving assembly and a motor which drives the air moving assembly. A control circuit controls operation of the motor as a function of the elapsed period.

Still another form of the invention is a circuit which controls a motor coupled to an air moving assembly in a refrigerator. The refrigerator has a compartment to be refrigerated, a compressor, an evaporator and a condenser. The refrigerator also has a temperature sensor positioned in association with the compartment which outputs a sensed temperature signal as a function of the temperature in the compartment. The apparatus includes a reference circuit which provides a desired temperature signal representative of a desired temperature and a comparator which compares the desired temperature signal and the sensed temperature signal and generates a cool signal when the compartment temperature is above the desired temperature. A timer times out an elapsed period of time in response to the cool signal is generated. The apparatus also includes a control circuit which controls operation of the motor as a function of the elapsed period.

Yet still another form of the invention is a method of driving an air moving assembly in a refrigerator. The refrigerator has a compartment to be refrigerated, a compressor, an evaporator and a condenser. The refrigerator also has a temperature sensor positioned in association with the compartment for indicating the temperature in the compartment. The desired temperature and the sensed temperature are compared and a cool signal is generated when the compartment temperature is above the desired temperature. An elapsed period of time is timed out in response to the cool signal is generated. The method also includes the steps of providing a motor including a rotatable assembly in driving relation to the fan and controlling operation of the motor as a function the elapsed period.

Another form of the invention is an apparatus for driving an air moving assembly as part of a system for controlling temperature within a compartment. A compressor compresses a working fluid to be condensed in a condenser and to be evaporated in an evaporator for heating or cooling the compartment. A temperature sensor positioned in association with the compartment outputs a sensed temperature signal as a function of the temperature in the compartment. A reference circuit provides a desired temperature signal representative of a desired temperature. A comparator responsive to the reference circuit and the temperature sensor compares the desired temperature signal and the sensed temperature signal and generates a demand signal when the compartment temperature is below or above the desired temperature. A timer responsive to the comparator times out an elapsed period of time in response to the demand signal is generated. A motor includes a rotatable assembly in driving relation to the air moving assembly. A control circuit responsive to the timer controls operation of the motor as a function of the elapsed period.

Other objects and features will be in part apparent and in part pointed out hereinafter.

DETAILED DESCRIPTION OF A PREFERRED EMBODIMENT

Figure 1:
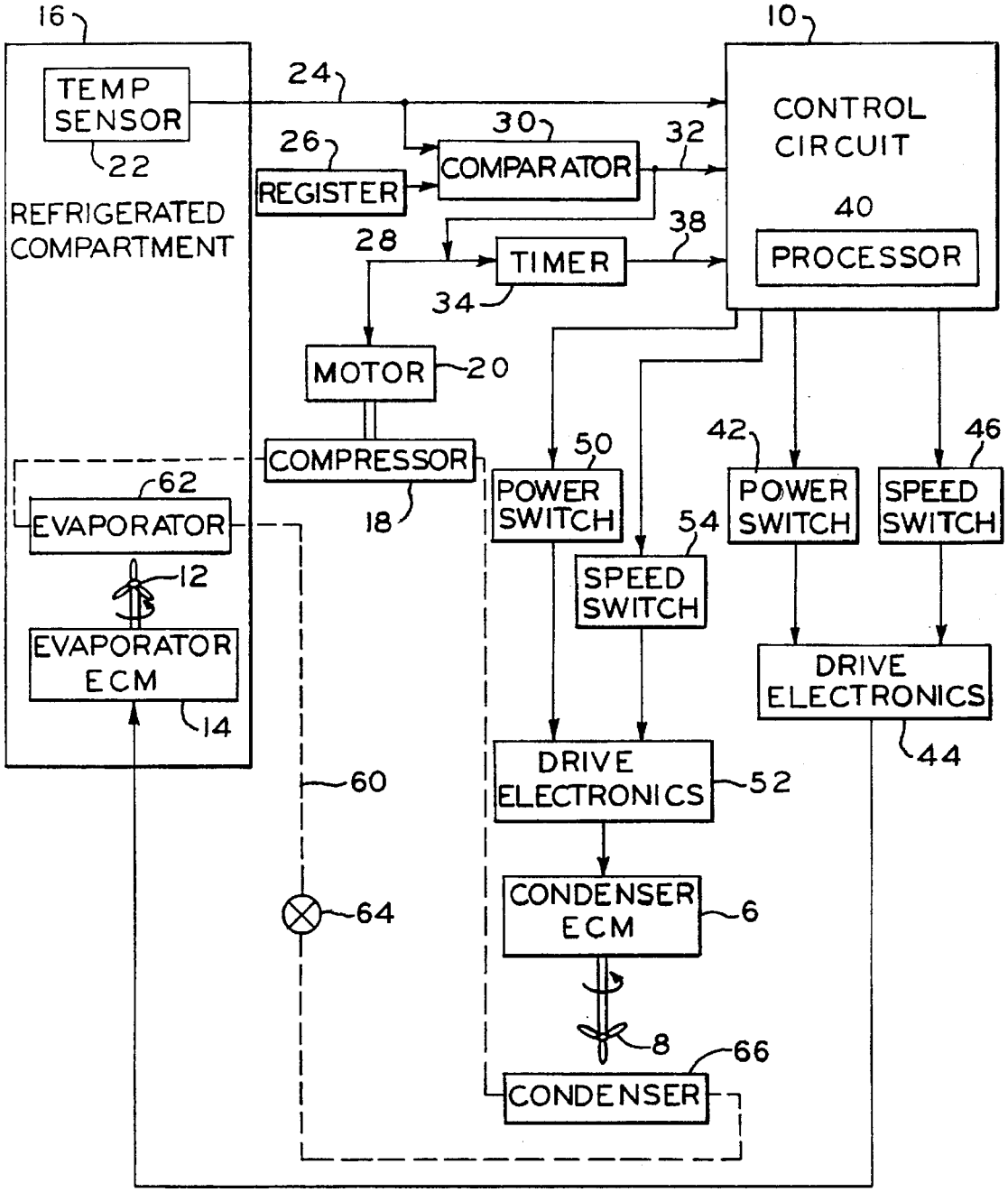
FIG. 1 shows a block diagram of a refrigeration system including a circuit for controlling the operation of an evaporator fan and/or a condenser fan according to the invention.

FIG. 1 shows a refrigerator control circuit 10 for providing variable speed operation (preferably two speed) for an air moving assembly such as blades forming an evaporator fan 12 driven by a motor 14 in a refrigerated compartment 16. Control circuit 10 also provides variable speed operation (preferably two speed) for a condenser fan 8 driven by a motor 6. In general, variable speed or multispeed circuits are disclosed in the following coassigned patents, the entire disclosure of which are incorporated herein by reference: U.S. Pat. Nos. 4,005,347; 4,015,182; 4,169,990; 4,449,079; 4,459,519; and 5,075,608.

A compressor 18 is driven by a motor 20. Motors 6, 14 and 20 may be any electronically controllable motor typically powered by an electronic commutating circuit. Such motors include single and variable speed motors, selectable speed motors having a plurality of finite, discrete speeds and brushless dc motors, including electronically commutated motors and switched reluctance motors. In addition, the motors may have a single winding, a split phase winding or a multiphase winding. Motors 6, 14 and 20 may also provide finite, discrete speeds selected by an electrical switch or the like. A refrigerant line 60 shows the path of the working fluid as it passes from an evaporator 62 to an expansion valve 64 to a condenser 66 to compressor 18 and back to the evaporator in known fashion.

Control circuit 10 is connected to a temperature sensor 22 positioned adjacent or within refrigerated compartment 16 for outputting a sensed temperature signal on a line 24 as a function of the temperature in the compartment. A storage register 26 or other memory device or circuit stores data representative of a desired temperature for compartment 16. The data in register 26 is passed via a line 28 to a comparator 30. Comparator 30 compares the sensed temperature signal on line 24 with the data in register 26 and generates a cool demand signal on a line 32 during periods of time when the compartment temperature as represented by the sensed temperature signal rises above the desired temperature as represented by the data. Register 26 thus functions as a reference circuit for setting the temperature of compartment 16.

The cool signal on line 32 switches on or activates motor 20 to drive compressor 18. The cool signal from comparator 30 is also received by a timer 34. Timer 34 responds to the cool signal by resetting itself and then timing out an elapsed period of time in response to the cool signal. For example, the elapsed period may commence when the cool signal was received and/or compressor 18 was activated.

Control circuit 10 also receives the cool signal from comparator 30 via line 32. Control circuit 10 also receives the ongoing elapsed period of time timed out by timer 34 via a line 38. Control circuit 10 also receives the sensed temperature signal from temperature sensor 22 via line 24. Control circuit 10 includes a processor 40 for calculating a value of a variable "EFAN-ON" signal according to the equation:

$$EFAN\text{-}ON = A^*(\text{elapsed time}) - B^*(\text{temp. signal}) + C \quad [1]$$

In this equation, "elapsed time" represents the elapsed time output by timer 34, "temp. signal" represents the sensed temperature signal output by temperature sensor 22, and A, B and C are preselected constants determined to optimize the time delay for activating the evaporator fan for a particular refrigerator design. During periods of time following a cool signal from comparator 30 when "EFAN-ON" corresponds to a positive number, control circuit 10 switches on motor 14 via a power switch 42 and a set of drive electronics 44. Accordingly, control circuit 10 is responsive to processor 40 for switching on motor 14 to drive evaporator fan 12 as a function of the variable "EFAN-ON." Although circuit 40 is shown to include microprocessor 40, those skilled in the art will recognize other logic circuits for implementing the invention.

After evaporator fan 12 has been switched on and the refrigeration system begins cooling the compartment 16, control circuit 10 next determines the speed at which motor 14 should operate. Accordingly, processor 40 calculates a value of a variable "EFAN-HI" signal according to the equation:

$$EFAN\text{-}HI = D^*(\text{elapsed time}) + E^*(\text{temp. signal}) - F \quad [2]$$

In this equation, "elapsed time" represents the elapsed time output by timer 34, "temp. signal" represents the sensed temperature signal output by temperature sensor 22, and D, E and F are preselected constants determined to optimize the evaporator fan speed for a particular refrigerator design. Control circuit 10 is responsive to processor 40 for controlling the speed of motor 14 and evaporator fan 12 as a function of the variable "EFAN-HI" signal. When motor 14 is a two speed motor having a high speed and a low speed of operation, control circuit 10 is responsive to processor 40 to control motor 14 to operate at the low speed unless the variable "EFAN-HI" signal corresponds to a positive number, in which event motor 14 operates at the high speed. Control circuit 10 controls the speed of motor 14 via a conventional speed switch 46 and drive electronics 44.

Processor 40 of control circuit 10 also calculates a value of a variable "CFAN-ON" signal according to the equation:

$$CFAN\text{-}ON = G^*(\text{elapsed time}) - H^*(\text{temp. signal}) + I \quad [3]$$

In this equation, "elapsed time" represents the elapsed time output by timer 34, "temp. signal" represents the sensed temperature signal output by temperature sensor 22, and G, H and I are preselected constants determined to optimize the time delay for activating the condenser fan for a particular refrigerator design. During periods of time following a cool signal from comparator 30 when "CFAN-ON" corresponds to a positive number, control circuit 10 switches on motor 6 via a power switch 50 and a set of drive electronics 52. Accordingly, control circuit 10 is responsive to processor 40 for switching on motor 6 to drive condenser fan 8 as a function of the variable "CFAN-ON."

An alternative to the implementation of equation [3] via processor 40 and control circuit 10 as described above would be to automatically turn on motor 6 whenever compressor motor 20 is turned on. This could be accomplished through the design of control circuit 10 and processor 40 or else by simply connecting line 32 to power switch 50 (not shown). The result would be a simpler circuit design for situations where delayed operation of condenser fan 8 was not desired. A second alternative would be to provide for a fixed delay of, e.g. 15 secs., each time after compressor motor 20 was turned on. Such a fixed delay could be programmed into processor 40 and implemented via control circuit 10. Likewise, a conventional timer of known duration could be used to delay the turn on time of motor 6.

Control circuit 10 also determines the speed at which motor 6 should operate. Accordingly, processor 40 calculates a value of a variable "CFAN-HI" signal according to the equation:

$$CFAN\text{-}HI = J^*(\text{elapsed time}) + K^*(\text{temp. signal}) - L \quad [4]$$

In this equation, "elapsed time" represents the elapsed time output by timer 34, "temp. signal" represents the sensed temperature signal output by temperature sensor 22, and J, K and L are preselected constants determined to optimize the condenser fan speed for a particular refrigerator design. Control circuit 10 is responsive to processor 40 for controlling the speed of motor 6 and condenser fan 8 as a function of the variable "CFAN-HI" signal. When motor 6 is a two speed motor having a high speed and a low speed of operation, control circuit 10 is responsive to processor 40 to control motor 6 to operate at the low speed unless the variable "CFAN-HI" signal corresponds to a positive number, in which event motor 6 operates at the high speed. Control circuit 10 controls the speed of motor 6 via a conventional speed switch 54 and drive electronics 52.

Under normal operating conditions, motors 6 and 12 will start on low speed and switch to high speed only if the on cycle elapsed time is excessively long or if the compartment air temperature is excessively warm. Accordingly, control circuit 10 is responsive to temperature sensor 22 and timer 34 for controlling operation of motor 6 driving fan 8 and motor 14 driving evaporator fan 12 as a function of the sensed temperature signal and the elapsed period. By operating fans 8 and 12 at a lower speed, fan noise is reduced considerably below the fan noise at maximum load.

It has been found in some situations, particularly where the external temperature is warm, that reducing the operating speed or delaying the turn on time of the condenser fan motor 6 results in an increased load on compressor motor 18 and an increased consumption of energy by compressor motor 20. It may be advisable in such a situation to turn on motor 6 at the high speed at the same time that compressor motor 20 is turned on. An alternative is to use an oversized condenser fan 8. Such an oversized fan allows for lower operating speeds of motor 6 over a wider range of external temperatures with reduced noise.

In practice, the features of the invention shown in FIG. 1 can be used separately. For example, one refrigerator might include just the circuitry for controlling the turn on point and speed for evaporator fan 12 and motor 14 shown in FIG. 1. Another refrigerator might include just the circuitry for controlling the turn on point and speed of condenser motor 6 and fan 8 shown in FIG. 1.

It is contemplated that the invention may be used in a heating environment as well as described above with respect to a cooling environment. Therefore, the invention may constitute an apparatus for driving an air moving assembly (fan 8) as part of a system for controlling temperature within a compartment (16). A compressor (18) compresses a working fluid to be condensed in a condenser (6) for heating the compartment and to be evaporated in an evaporator (62). A temperature sensor (22) positioned in association with the compartment outputs a sensed temperature signal as a function of the temperature in the compartment. A reference circuit (comparator 30) provides a desired temperature signal representative of a desired temperature. A comparator (30) responsive to the reference circuit and the temperature sensor compares the desired temperature signal and the sensed temperature signal and generates a demand signal (32) when the compartment temperature is below the desired temperature. A timer (34) responsive to the comparator times out an elapsed period of time in response to the demand signal (on line 32). A motor (6) includes a rotatable assembly in driving relation to the air moving assembly. A control circuit (10) responds to the timer for controlling operation of the motor as a function of the elapsed period.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An apparatus for driving an air moving assembly as part of a refrigerator having a compartment, the refrigerator including:

a compressor for compressing a working fluid to be condensed in a condenser and to be evaporated in an evaporator for cooling the compartment; and a temperature sensor positioned in association with the compartment for outputting a sensed temperature signal as a function of the temperature in the compartment;

the apparatus comprising:

a reference circuit for providing a desired temperature signal representative of a desired temperature;

a comparator responsive to the reference circuit and the temperature sensor for comparing the desired temperature signal and the sensed temperature signal and for generating a cool signal when the compartment temperature is above the desired temperature;

a timer responsive to the comparator for timing out an elapsed period of time in response to the cool signal;

a motor including a rotatable assembly in driving relation to the air moving assembly; and a control circuit responsive to the timer and responsive to the temperature sensor for controlling operation of the motor as a function of the elapsed period as indicated by the timer and as a function of the sensed temperature signal as indicated by the temperature sensor.

2. The apparatus of claim 1 wherein the air moving assembly is an evaporator fan, wherein the rotatable assembly of the motor is in driving relation to the evaporator fan in the compartment for moving air in the compartment and further comprising a processor for providing an "EFAN-ON" signal according to the equation:

$$EFAN\text{-}ON = A^*(\text{elapsed time}) - B^*(\text{temp. signal}) + C,$$

wherein "elapsed time" is the elapsed period of time timed out by the timer, and "temp. signal" is the sensed temperature signal output by the temperature sensor, A, B and C are constants and wherein the control circuit is responsive to the processor for activating the motor as a function of the "EFAN-ON" signal.

3. The apparatus of claim 2 wherein the control circuit activates the motor during periods of time when the variable "EFAN-ON" signal is positive.

4. The apparatus of claim 1 wherein the reference circuit comprises a storage register for storing data corresponding to the desired temperature; wherein the motor comprises a variable speed motor; wherein the air moving assembly is an evaporator fan, wherein the rotatable assembly is in driving relation to the evaporator fan; and wherein the control circuit controls the speed or torque of the variable speed motor as a function of the sensed temperature signal and the elapsed period.

5. The apparatus of claim 4 wherein the processor provides an "EFAN-HI" signal according to the equation:

$$EFAN\text{-}HI = D^*(\text{elapsed time}) + E^*(\text{temp. signal}) - F$$

wherein "elapsed time" is the elapsed period of time timed out by the timer, and "temp. signal" is the sensed temperature signal output by the temperature sensor, D, E and F are constants and wherein the control circuit is responsive to the processor for controlling the speed/torque of the variable speed motor as a function of the "EFAN-HI" signal.

6. The apparatus of claim 5 wherein the variable speed motor comprises a two speed motor for providing a high speed and a low speed of operation.

7. The apparatus of claim 6 wherein the control circuit controls the two speed motor to operate the fan at the low speed unless the "EFAN-HI" signal is positive.

8. The apparatus of claim 7 further comprising a variable speed condenser motor driving a fan for moving air over the condenser; and wherein the control circuit controls the speed or torque of the variable speed motor as a function of the sensed temperature signal and the elapsed period.

9. The apparatus of claim 8 wherein the processor provides a "CFAN-HI" signal according to the equation:

$$CFAN\text{-}HI = J^*(\text{elapsed time}) + K^*(\text{temp. signal}) - L$$

wherein "elapsed time" is the elapsed period of time timed out by the timer, and "temp. signal" is the sensed temperature signal output by the temperature sensor, J, K and L are constants and wherein the control circuit is responsive to the processor for controlling the speed/torque of the variable speed condenser motor as a function of the "CFAN-HI" signal.

10. The apparatus of claim 9 wherein the variable speed condenser motor comprises a two speed condenser motor for providing a high speed and a low speed of operation.

11. The apparatus of claim 10 wherein the control circuit controls the two speed motor to operate the fan at the low speed unless the "CFAN-HI" signal is positive.

12. The apparatus of claim 1 wherein the air moving assembly is a condenser fan, wherein the rotatable assembly of the motor is in driving relation to the condenser fan for moving air over the condenser and further comprising a processor for providing a "CFAN-ON" signal according to the equation:

$$CFAN\text{-}ON = G^*(\text{elapsed time}) - H^*(\text{temp. signal}) + I,$$

wherein "elapsed time" is the elapsed period of time timed out by the timer, and "temp. signal" is the sensed temperature signal output by the temperature sensor, G, H and I are constants and wherein the control circuit is responsive to the processor for activating the motor as a function of the "CFAN-ON" signal.

13. The apparatus of claim 12 wherein the control circuit activates the motor during periods of time when the variable "CFAN-ON" signal is positive.

14. The apparatus of claim 1 wherein the reference circuit comprises a storage register for storing data corresponding to the desired temperature; wherein the motor comprises a variable speed motor; wherein the air moving assembly is a condenser fan; wherein the rotatable assembly is in driving relation to the condenser fan; and wherein the control circuit controls the speed or torque of the variable speed motor as a function of the sensed temperature signal and the elapsed period.

15. The apparatus of claim 14 wherein the processor provides an "CFAN-HI" signal according to the equation:

$$CFAN\text{-}HI = J^*(\text{elapsed time}) + K^*(\text{temp. signal}) - L$$

wherein "elapsed time" is the elapsed period of time timed out by the timer, and "temp. signal" is the sensed temperature signal output by the temperature sensor, J, K and L are constants and wherein the control circuit is responsive to the processor for controlling the speed/torque of the variable speed motor as a function of the "CFAN-HI" signal.

16. The apparatus of claim 15 wherein the variable speed motor comprises a two speed motor for providing a high speed and a low speed of operation.

17. The apparatus of claim 16 wherein the control circuit controls the two speed motor to operate the fan at the low speed unless the "CFAN-HI" signal is positive.

18. An apparatus for a refrigerator having a compartment, the refrigerator including:

a compressor for compressing a working fluid to be condensed in a condenser and to be evaporated in an evaporator for cooling the compartment; and a temperature sensor positioned in association with the compartment for outputting a sensed temperature signal as a function of the temperature in the compartment;

the apparatus comprising:

a reference circuit for providing a desired temperature signal representative of a desired temperature;

a comparator responsive to the reference circuit and the temperature sensor for comparing the desired temperature signal and the sensed temperature signal and for generating a cool signal when the compartment temperature is above the desired temperature;

a timer responsive to the comparator for timing out an elapsed period of time in response to the cool signal;

an air moving assembly;

a motor including a rotatable assembly in driving relation to the air moving assembly; and a control circuit responsive to the timer and responsive to the temperature sensor for controlling operation of the motor as a function of the elapsed period as indicated by the timer and as a function of the sensed temperature signal as indicated by the temperature sensor.

19. The apparatus of claim 18 wherein the reference circuit comprises a storage register for storing data corresponding to the desired temperature; wherein the motor comprises a variable speed motor; wherein the air moving assembly comprises an evaporator fan; and wherein the control circuit controls the speed or torque of the variable speed motor as a function of the sensed temperature signal and the elapsed period.

20. The apparatus of claim 18 wherein the reference circuit comprises a storage register for storing data corresponding to the desired temperature; wherein the motor comprises a variable speed motor; wherein the air moving assembly comprises a condenser fan; and wherein the control circuit controls the speed or torque of the variable speed motor as a function of the sensed temperature signal and the elapsed period.

21. A circuit for controlling a motor coupled to an air moving assembly in a refrigerator, the refrigerator including:

a compartment to be refrigerated;

a compressor for compressing a working fluid to be condensed in a condenser and to be evaporated in an evaporator for cooling the compartment; and a temperature sensor positioned in association with the compartment for outputting a sensed temperature signal as a function of the temperature in the compartment;

the apparatus comprising:

a reference circuit for providing a desired temperature signal representative of a desired temperature;

a comparator responsive to the reference circuit and the temperature sensor for comparing the desired temperature signal and the sensed temperature signal and for generating a cool signal when the compartment temperature is above the desired temperature;

a timer responsive to the comparator for timing out an elapsed period of time in response to the cool signal; and a control circuit responsive to the timer and responsive to the temperature sensor for controlling operation of the motor as a function of the elapsed period as indicated by the timer and as a function of the sensed temperature signal as indicated by the temperature sensor.

22. A method of driving an air moving assembly in a refrigerator, the refrigerator including:

a compartment to be refrigerated;

a compressor for compressing a working fluid to be evaporated in an evaporator and to be condensed in a condenser; and a temperature sensor positioned in association with the compartment for indicating the temperature in the compartment;

the method comprising the steps of:

comparing the sensed temperature to a desired temperature and generating a cool signal when the compartment temperature is above the desired temperature;

timing out an elapsed period of time in response to the cool signal;

providing a motor including a rotatable assembly in driving relation to the air moving assembly; and controlling operation of the motor as a function of the elapsed period and as a function of the sensed temperature signal.

23. An apparatus for driving an air moving assembly as part of a system for controlling temperature within a compartment, the system including:

a compressor for compressing a working fluid to be condensed in a condenser and to be evaporated in an evaporator, said condenser for heating or cooling the compartment or said evaporator for cooling the compartment; and a temperature sensor positioned in association with the compartment for outputting a sensed temperature signal as a function of the temperature in the compartment;

the apparatus comprising:

a reference circuit for providing a desired temperature signal representative of a desired temperature;

a comparator responsive to the reference circuit and the temperature sensor for comparing the desired temperature signal and the sensed temperature signal and for generating a demand signal when the compartment temperature is below or above the desired temperature;

a timer responsive to the comparator for timing out an elapsed period of time in response to the demand signal;

a motor including a rotatable assembly in driving relation to the air moving assembly; and a control circuit responsive to the timer and responsive to the temperature sensor for controlling operation of the motor as a function of the elapsed period as indicated by the timer and as a function of the sensed temperature signal as indicated by the temperature sensor.

* * * * *